US010253985B2

(12) United States Patent
Maurer et al.

(10) Patent No.: US 10,253,985 B2
(45) Date of Patent: Apr. 9, 2019

(54) SEQUENTIAL LINER FOR A GAS TURBINE COMBUSTOR

(71) Applicant: General Electric Technology GmbH, Baden (CH)

(72) Inventors: Michael Thomas Maurer, Bad Sackingen (DE); Jeffrey De Jonge, Baden (CH); Felix Baumgartner, Waldshut-Tiengen (DE); Patrik Meng, Gipf-Oberbrick (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 427 days.

(21) Appl. No.: 15/050,161

(22) Filed: Feb. 22, 2016

(65) Prior Publication Data

US 2016/0258625 A1 Sep. 8, 2016

(30) Foreign Application Priority Data

Mar. 5, 2015 (EP) ..... 15157730

(51) Int. Cl.
*F23R 3/04* (2006.01)
*F01P 7/02* (2006.01)
*F23R 3/00* (2006.01)

(52) U.S. Cl.
CPC ..... *F23R 3/04* (2013.01); *F01P 7/02* (2013.01); *F23R 3/005* (2013.01); (Continued)

(58) Field of Classification Search
CPC ..... F23R 3/54; F23R 2900/00016; F23R 2900/00017; F23R 2900/03043; F05D 2260/20; F01D 9/023
See application file for complete search history.

(56) References Cited

U.S. PATENT DOCUMENTS 4,236,378 A * 12/1980 Vogt ..... F23R 3/002 60/748
4,297,843 A 11/1981 Sato et al.
(Continued)

FOREIGN PATENT DOCUMENTS

EP 2 206 886 A2 7/2010
EP 2 439 452 A2 4/2012
(Continued)

OTHER PUBLICATIONS

Extended European Search Report dated Aug. 14, 2015, issued by the European Patent Office in the corresponding European Patent Application No. 15157730.1-1605. (7 pages).

*Primary Examiner* — Carlos A Rivera
(74) *Attorney, Agent, or Firm* — Buchanan Ingersoll & Rooney PC

(57) ABSTRACT

The invention concerns a sequential liner for a gas turbine combustor, having a sequential liner outer wall spaced apart from a sequential liner inner wall to define a sequential liner cooling channel between the sequential liner outer wall and the sequential liner inner wall. The sequential liner outer wall includes a first face, a first adjacent face and a second adjacent face, the first and second adjacent faces each being adjacent to the first face, the first face of the sequential liner outer wall having a first convective cooling hole adjacent to the first adjacent face and a second convective cooling hole adjacent to the second adjacent face, each convective cooling hole being arranged to direct a convective cooling flow into the sequential liner cooling channel adjacent to each adjacent face. The invention also concerns a method of cooling using the sequential liner and a method of retrofitting a gas turbine.

14 Claims, 4 Drawing Sheets

(52) U.S. Cl.
CPC ..... *F05D 2230/80* (2013.01); *F23R 2900/00016* (2013.01); *F23R 2900/03043* (2013.01); *F23R 2900/03044* (2013.01)

(56) References Cited

U.S. PATENT DOCUMENTS

| | | | | |
|---|---|---|---|---|
| 8,307,654 | B1 * | 11/2012 | Liang | F01D 9/023 60/39.37 |
| 2010/0170259 | A1 * | 7/2010 | Huffman | F01D 9/023 60/755 |
| 2011/0107766 | A1 * | 5/2011 | Davis, Jr. | F23R 3/005 60/755 |
| 2012/0159954 | A1 * | 6/2012 | Ito | F01D 9/023 60/752 |
| 2014/0079828 | A1 | 3/2014 | Heaton et al. | |
| 2014/0109579 | A1 * | 4/2014 | Dusing | F01D 9/023 60/722 |
| 2014/0260278 | A1 * | 9/2014 | Hughes | F23R 3/002 60/752 |
| 2014/0318136 | A1 * | 10/2014 | Saitou | F01D 9/023 60/740 |
| 2015/0033697 | A1 * | 2/2015 | Morrison | F01D 9/023 60/39.83 |
| 2015/0118019 | A1 * | 4/2015 | Maurer | F01D 25/14 415/1 |
| 2015/0267918 | A1 * | 9/2015 | Maurer | F02C 3/04 60/726 |
| 2015/0377134 | A1 * | 12/2015 | Maurer | F02C 7/18 60/754 |
| 2017/0284679 | A1 * | 10/2017 | Rodriguez | F23R 3/425 |
| 2018/0051578 | A1 * | 2/2018 | Marlow | F01D 9/023 |

FOREIGN PATENT DOCUMENTS

| | | | |
|---|---|---|---|
| EP | 2 469 033 | A2 | 6/2012 |
| EP | 2 725 197 | A1 | 4/2014 |
| JP | 2003-286863 | A | 10/2003 |

* cited by examiner 30
18
26
25
22
12
B
24

10
16
18
14
12
32
18
A
16
32
34
20

20
22
18
30
26
25
24
12
27
28

SEQUENTIAL LINER FOR A GAS TURBINE COMBUSTOR

TECHNICAL FIELD

The present disclosure relates to sequential liners for gas turbine combustors, and in particular to convective cooling holes in sequential liners.

BACKGROUND OF THE INVENTION

In gas turbine can combustors, a sequential liner with impingement cooling is used. When a set of gas turbine can combustors are arranged around the turbine, the cans can be close together, and the proximity of adjacent cans to one another can hinder cooling air ingress to the impingement cooling holes. It has been appreciated that improvements can be made to ameliorate this issue.

SUMMARY OF THE INVENTION

According to a first aspect of the invention, a sequential liner for a gas turbine combustor is provided, comprising a sequential liner outer wall spaced apart from a sequential liner inner wall to define a sequential liner cooling channel between the sequential liner outer wall and the sequential liner inner wall, the sequential liner outer wall comprising a first face, a first adjacent face and a second adjacent face, the first and second adjacent faces each being adjacent to the first face, the first face of the sequential liner outer wall comprising a first convective cooling hole adjacent to the first adjacent face and a second convective cooling hole adjacent to the second adjacent face, each convective cooling hole being arranged to direct a convective cooling flow into the sequential liner cooling channel adjacent to each adjacent face.

Feeding of impingement systems on the sequential liner sidewalls can be difficult due to the high velocities in between two neighbouring sequential liners (with associated low pressure to feed the cooling system), and the short distance to the neighbouring sequential liner may also result in unstable feeding of the cooling system (cooling pulsations). Changing the position of the cooling air ingress to a location that can have a higher static pressure drop can provide a higher driving pressure drop for the cooling system.

Impingement cooling also requires a certain cooling channel height, which significantly affects the size of the non-flowed area between two sequential liners at the turbine interface. It may be possible to decrease the channel height in the area being convectively cooled, as convective cooling can be much more compact. This can allow the cans within the sequential liners to be placed closer together, which can provide space for more cans.

Due to the more uniform temperature field that can be provided with convective (convection) cooling compared to impingement cooling, the deformation of the part and the loads on the part can be more evenly distributed which can also be beneficial for lifetime.

In one embodiment, the sequential liner comprises at least one rib between the sequential liner inner wall and the sequential liner outer wall of the first adjacent face for directing the convective cooling flow. A rib or ribs can help direct the cooling flow. Adding a rib can also have the advantage that it helps to increase the stiffness of the sequential liner sidewalls and can therefore help improve the creep resistance and HCF (high-cycle fatigue) lifetime of the part. The rib structure can also improve heat conduction of the sequential liner inner and outer walls.

In one embodiment, the at least one rib extends across part of the distance between the sequential liner outer wall and the sequential liner inner wall. In one embodiment, at least one of the one or more ribs is substantially parallel to a gas turbine combustor hot gas flow. In one embodiment, the sequential liner comprises a plurality of ribs, wherein each rib has a downstream end and an upstream end relative to the flow of cooling air, and wherein the upstream ends of the ribs are further apart from one another than the downstream ends of the ribs. In one embodiment, one or more of the ribs are curved. In one embodiment, at least one first convective cooling hole comprises at least two separate holes adjacent to one another. In one embodiment, the longest distance across at least one of the first convective cooling holes is at least twice the length of the shortest distance across said convective cooling hole. Preferably, the first convective cooling hole and the second convective cooling hole are the same. These embodiments can help direct the cooling flow.

In one embodiment, the sequential liner comprises a plurality of impingement cooling holes in the sequential liner outer wall. This can help with sequential liner inner wall cooling.

In one embodiment, the plurality of impingement cooling holes are smaller than the convective cooling holes.

According to a second aspect of the invention, a gas turbine comprising the sequential liner as described above is provided.

According to a third aspect of the invention, there is provided a method of cooling a sequential liner for a gas turbine combustor comprising a sequential liner outer wall spaced apart from a sequential liner inner wall to define a sequential liner cooling channel between the sequential liner outer wall and the sequential liner inner wall, the sequential liner outer wall comprising a first face, a first adjacent face and a second adjacent face, the first and second adjacent faces each being adjacent to the first face, the first face of the sequential liner outer wall comprising a first convective cooling hole adjacent to the first adjacent face and a second convective cooling hole adjacent to the second adjacent face, each convective cooling hole being arranged to direct a convective cooling flow into the sequential liner cooling channel adjacent to each adjacent face, the method comprising: feeding cooling air through the convective cooling holes into the sequential liner cooling channel; and convectively cooling the sequential liner inner wall with the cooling air.

According to a fourth aspect of the invention, there is provided a method of retrofitting a gas turbine comprising a sequential liner with a sequential liner outer wall spaced apart from a sequential liner inner wall to define a sequential liner cooling channel between the sequential liner outer wall and the sequential liner inner wall, the method comprising: removing the sequential liner outer wall; and adding a new sequential liner outer wall, the sequential liner outer wall comprising a first face, a first adjacent face and a second adjacent face, the first and second adjacent faces each being adjacent to the first face, the first face of the sequential liner outer wall comprising a first convective cooling hole adjacent to the first adjacent face and a second convective cooling hole adjacent to the second adjacent face, each convective cooling hole being arranged to direct a convective cooling flow into the sequential liner cooling channel adjacent to each adjacent face.

In one embodiment, the method comprises the step of attaching at least one rib to the sequential liner inner wall before adding a new sequential liner outer wall.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figures 1, 2A:
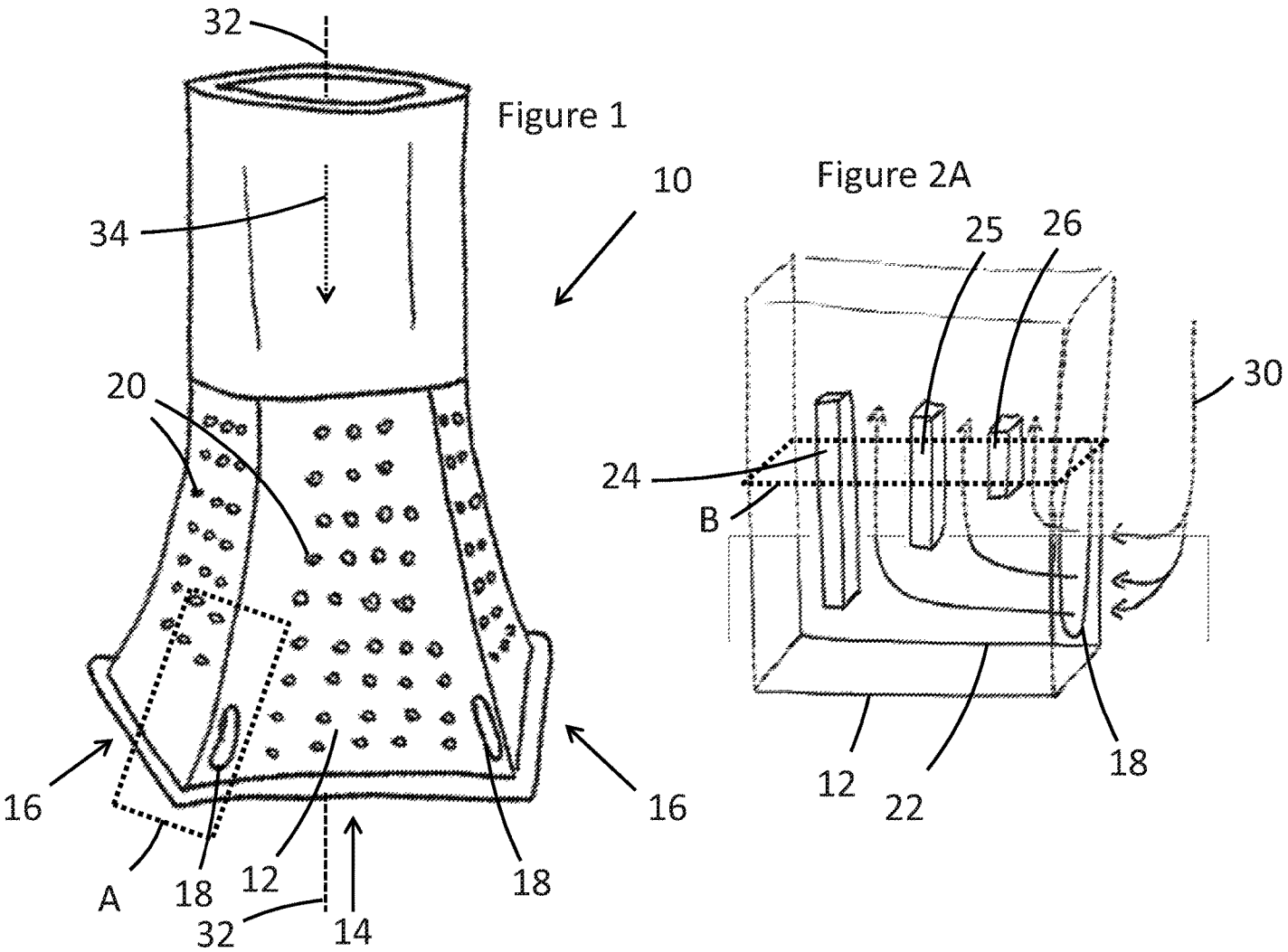
FIG. 1 shows a perspective view of a sequential liner.
FIG. 2A shows a partially cut-out perspective view of the portion A of FIG. 1.
Figures 2B, 6, 7:
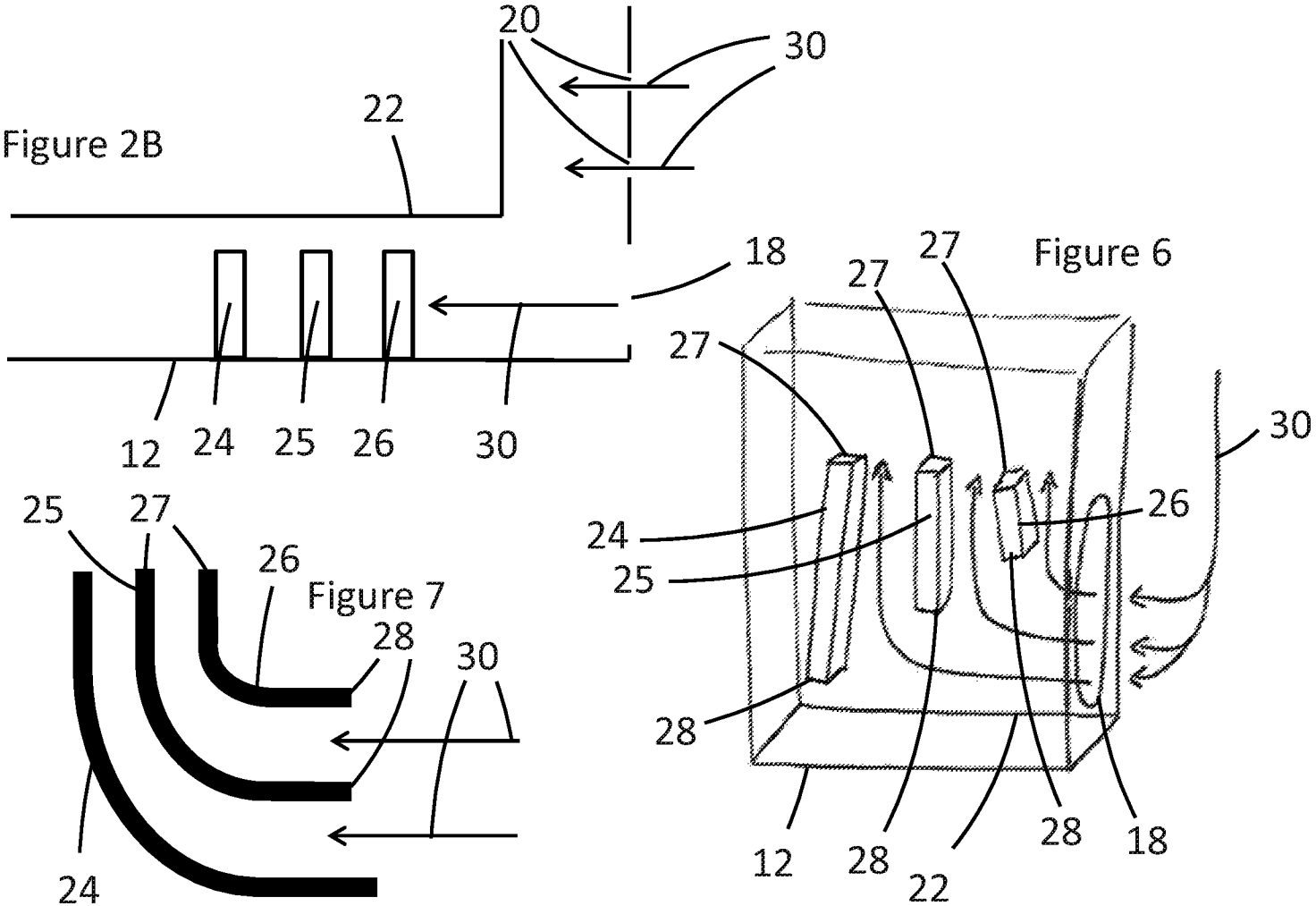
FIG. 2B shows a cross-section B of FIG. 2A.
FIG. 6 shows a partially cut-out perspective view of the portion A of FIG. 1 with an alternative rib configuration.
FIG. 7 shows a cross-section of another alternative rib configuration.

A sequential liner 10 is shown in FIGS. 1, 2A and 2B. The sequential liner 10 comprises an outer wall 12 divided into an inside face 14, two side faces 16 and an outside face (not shown). There are two convective cooling holes 18 in the inside face 14 and a plurality of impingement cooling holes 20 in the inside face 14, the side faces 16 and the outside face 18.

FIG. 2A shows a partial cut-out view of roughly the portion A of FIG. 1, showing the structure between outer wall 12 and inner wall 22. There is a sequential liner cooling channel between outer wall 12 and inner wall 22. Ribs 24, 25, 26 are shown extending between the outer wall 12 and the inner wall 22. These ribs are optional. Cooling air paths 30 are also shown.

FIG. 2B shows a cross-section B of FIG. 2A. In this example, ribs 24, 25 and 26 are attached to the outer wall 12 and extend about 75% of the distance across the sequential liner cooling channel between the outer wall 12 and the inner wall 22. It is noted that although the outer wall 12 and inner wall 22 are shown as straight in FIG. 2B, this is not necessarily the case.

Figure 3:
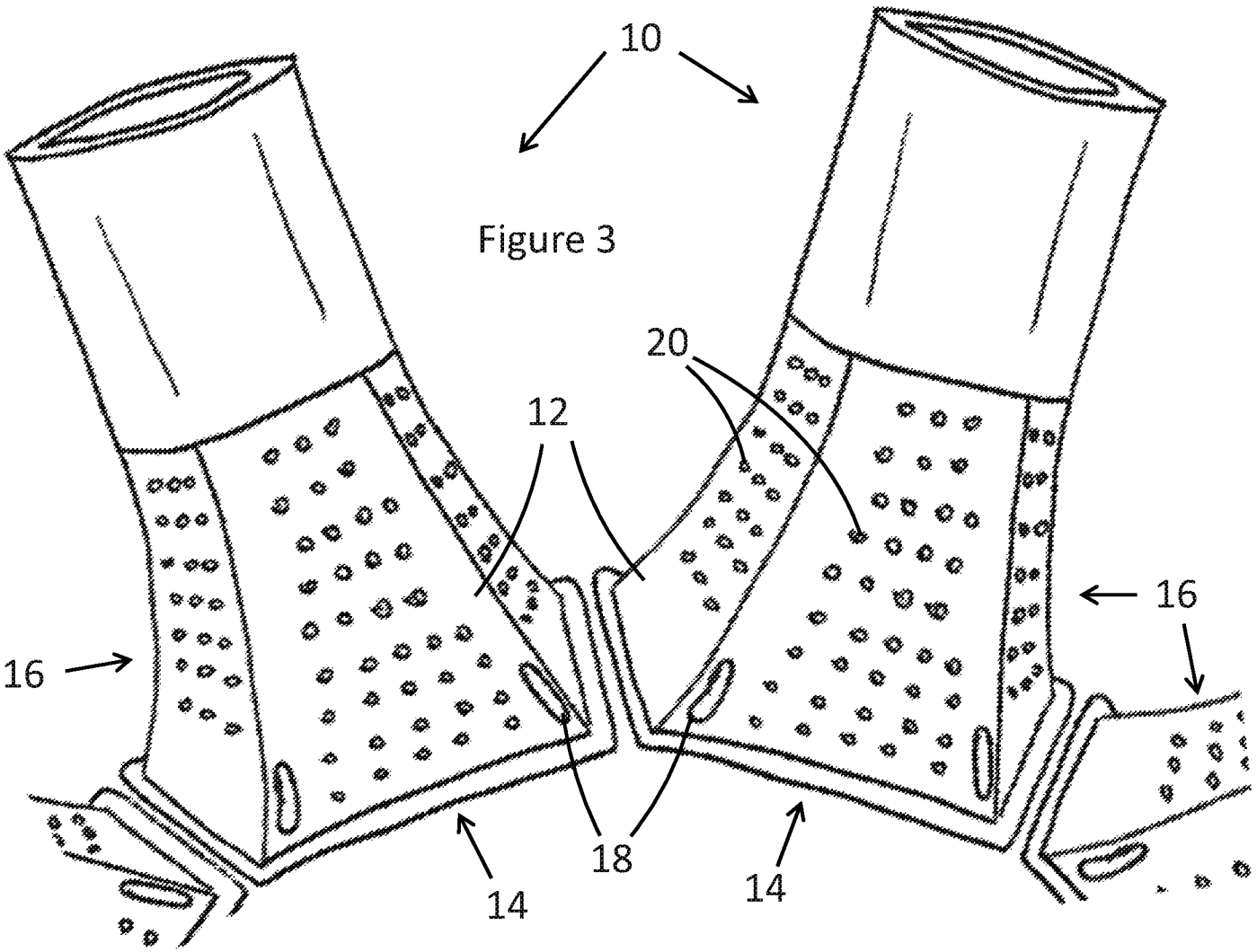
FIG. 3 shows a perspective view of part of a gas turbine combustor using the sequential liners of FIG. 1.

FIG. 3 shows part of a gas turbine combustor and shows the relative placement of sequential liners next to one another in a typical configuration, with the sequential liners adjacent to one another and arranged in a ring around a central axis. The sequential liners described herein would generally be used to surround each can in a can combustor. The hot gas will normally flow in hot gas flow direction 34 (see FIG. 1) through the can. Cooling holes are shown on the inside face 14 of the sequential liners; the convective cooling holes 18 are described above as being in the inside face 14 of the outer wall in this application, but could also be in the outside face (not shown) instead of the inside face, or in both the inside face and the outside face.

Figure 4:
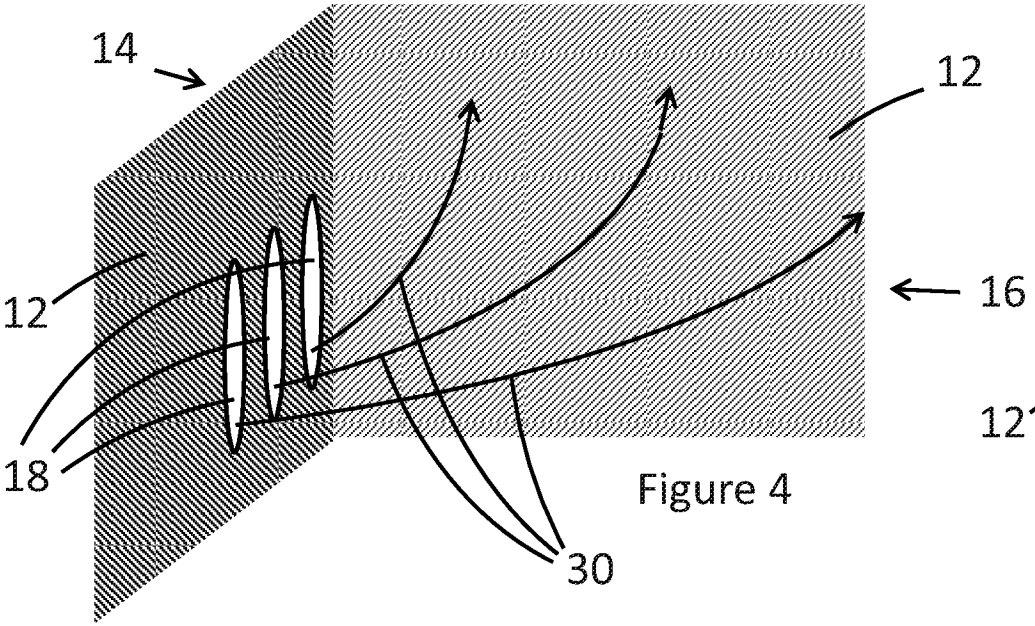
FIG. 4 shows a cut-out perspective view of part of a sequential liner cooling channel with an alternative configuration of convective cooling holes.

FIG. 4 shows a cut-out perspective view of part of the sequential liner cooling channel, looking away from the sequential liner longitudinal axis 32 from within the sequential liner cooling channel. Instead of a single convective cooling hole in the inside face 14 adjacent to the side face 16, three convective cooling holes are provided, side by side in the sequential liner longitudinal axis direction. Cooling air entering from the hole closest to side face 16 will interact more with the side face 16, essentially resulting in greater friction and in the cooling air moving towards the cooling air exit (not shown) (i.e. moving parallel to the sequential liner longitudinal axis) without moving very far across the side face 16. In contrast, air from the hole furthest from side 16 will have relatively little interaction with the side face 16, and will therefore travel much further across the side wall (i.e. further perpendicular to the sequential liner longitudinal axis) before moving towards the cooling air exit. Generally, the cooling air flow in the sequential liner cooling channel is in the opposite direction to the hot gas flow inside the sequential liner inner wall.

In some cases, a similar effect to that shown in FIG. 4 could be obtained by a single convective cooling hole, with an appropriately shaped hole (for example, a single hole extending across the whole width of the three holes shown in FIG. 4).

In a method of cooling using a sequential liner as described above, cooling air is fed in through convective cooling holes 18. The cooling air then passes through the sequential liner cooling channel, normally initially in a direction largely parallel to a plane perpendicular to the sequential liner longitudinal axis, before turning to pass up through the sequential liner cooling channel (generally in a direction opposite to the hot gas flow direction 34) to the cooling air exit (not shown).

In a method of retrofitting a gas turbine comprising a sequential liner with a sequential liner outer wall and a sequential liner inner wall, the sequential liner outer wall is first removed, followed by the addition of a new sequential liner outer wall as described above. If necessary, the method may additionally comprise the step of attaching at least one rib to the sequential liner inner wall before adding a new sequential liner outer wall as described elsewhere in this application.

The sequential liner 10 can be used on a can combustor or a cannular combustor, for example.

The convective cooling holes 18 may be oval in shape as shown in the Figures, or they may alternatively be rectangular, diamond, or another regular or irregular shape. Preferably, the convective cooling holes extend further in the sequential liner longitudinal axis direction than in the plane perpendicular to the sequential liner longitudinal axis. Preferably, the convective cooling holes are longer in the sequential liner longitudinal axis direction than in the plane perpendicular to the sequential liner longitudinal axis, with the longest distance across the convective cooling holes preferably being at least twice, most preferably three times, the length of the shortest distance across the convective cooling holes.

Figure 5:
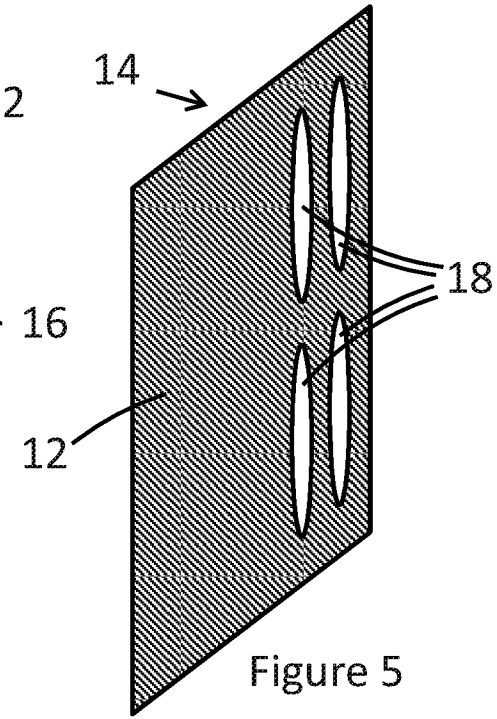
FIG. 5 shows another alternative configuration of convective cooling holes.

In FIG. 4, a group of three convective cooling holes is shown, but two, four or more cooling convective cooling holes could also be provided. Two or more convective cooling holes may also be provided in the sequential liner longitudinal axis direction, such as in FIG. 5. This may be advantageous where a large section of convective cooling is desired on the side face. Various other combinations are possible, such as removing any one or two of the four convective cooling holes in FIG. 5. Structural issues may be relevant when choosing which embodiment to use; it may be more complicated to manufacture embodiments with more than one convective cooling hole, but it may also provide structural advantages to have several smaller convective cooling holes rather than one large convective cooling hole.

The impingement cooling holes 20 may have scoops on the outside of the outer wall to direct air into the sequential liner cooling channel. In the examples shown, an area of side faces 16 adjacent to the convective cooling holes 20 does not have impingement cooling holes as it is convectively cooled, but in some embodiments impingement cooling holes may also be provided in this area, and there may be less impingement cooling holes than in areas without convective cooling. Areas without impingement cooling holes are typically the areas closest to adjacent sequential liners (see FIG. 3, for example). As a result, the side faces would typically have less impingement cooling holes than inside and outside faces.

The convective cooling holes 18 are arranged to direct a convective cooling flow into the sequential liner cooling channel adjacent to each adjacent face. As shown in FIG. 2B, the hole is preferably adjacent to the sequential liner cooling channel so that the air enters directly into the cooling channel. That is, the hole is situated in the part of the outer wall that does not directly face the inner wall, but that instead faces the cooling channel associated with the adjacent face. Impingement cooling holes, by contrast, are normally provided in the outer wall where it is directly opposite the inner wall (see for example FIGS. 1 and 2B).

Various properties and dimensions of the ribs can be modified, and some of these will now be described. Most of these properties and dimensions are not exclusive to one another, and can be mixed together in a wide variety of different ways. In FIG. 2B, the ribs 24, 25, 26 are shown attached to the outer wall and extending about 75% of the distance across the sequential liner cooling channel. However, various other embodiments are envisaged in which the ribs extend across the sequential liner cooling channel to different extents. The ribs may extend across the entire width of the sequential liner cooling channel and may be attached to only the outer wall (this can simplify retrofitting), only the inner wall, or both. In embodiments comprising more than one rib, the ribs can be different, for example with one rib attached to the outer wall 12 and another rib attached to the inner wall 22. Attaching the ribs to the inner walls can help improve the rigidity and creep lifetime of the inner wall, and can also help improve heat transfer from the inner wall.

The ribs may be applied to the outer and/or inner wall by CMT (cold metal transfer), brazing or conventional welding, for example. Laser metal forming could also be used in the case of a non-weldable metal being used.

The ribs may extend across the sequential liner cooling channel to a lesser extent than that shown in FIG. 2B, for example about 50% or about 25% of the distance across the channel. Preferably, the ribs extend at least 25% of the distance across the channel, more preferably at least 50% and most preferably at least 75%. In some embodiments, the rib closest to the convective cooling hole (rib 26 in FIG. 2B) extends to a lesser extent than the subsequent ribs. For example, the first rib extends about 25% (rib 26 in FIG. 2B), the second rib 50% (rib 25 in FIG. 2B) and the third rib 75% (rib 24 in FIG. 2B). Varying the extent that ribs extend across the sequential liner cooling channel can vary the cooling flow paths.

In FIGS. 2A and 2B, the ribs 24, 25, 26 are shown as parallel to one another. However, the ribs could also be converging as shown in FIG. 6, so that the ribs are converging towards their downstream end in the cooling air flow. That is, the downstream ends 27 of the ribs are closer together than the upstream ends 28. This can accelerate the flow and improve heat transfer. The ribs are typically arranged to be parallel or substantially parallel to the hot gas flow direction 34 in a burner inside the sequential liner. One or more of the ribs may also be curved. FIG. 7 shows an embodiment where the ribs are curved in such a way that the channels between the ribs are continuously converging in the portion of the channels between the curved part of the ribs. Continuously converging channels can prevent flow separation at the inside curve of the bend (i.e. the more tightly curved inside wall of the bend).

In FIG. 2A, the ribs are shown as having different lengths in the longitudinal direction, and with the rib closest to the convective cooling hole being the shortest rib. However, the ribs could all be the same length, or the shortest rib could be a rib other than the rib closest to the convective cooling hole.

In the embodiment shown in FIG. 4, no ribs are shown, though ribs could also be included. FIGS. 2A and 2B show three ribs, but one, two, four or more ribs may be used.

In the examples described herein, cooling air is used to provide a cooling fluid flow, but other cooling fluids may also be used.

Various modifications to the embodiments described are possible and will occur to those skilled in the art without departing from the invention which is defined by the following claims.

REFERENCE SIGNS

10 sequential liner
12 sequential liner outer wall
14 inside face
16 side face
18 convective cooling hole
20 impingement cooling hole
22 sequential liner inner wall
24 rib
25 rib
26 rib
27 downstream ends of the ribs
28 upstream ends of the ribs
30 cooling air path
32 sequential liner longitudinal axis
34 hot gas flow direction
A area
B cross-section

The invention claimed is:

1. A sequential liner for a gas turbine combustor, comprising:

a sequential liner outer wall spaced apart from a sequential liner inner wall to define a sequential liner cooling channel between the sequential liner outer wall and the sequential liner inner wall; and the sequential liner outer wall having a first face, a first adjacent face and a second adjacent face, the first and second adjacent faces each being adjacent to the first face, the first face of the sequential liner outer wall having a first convective cooling hole adjacent to the first adjacent face and a second convective cooling hole adjacent to the second adjacent face, each convective cooling hole facing the cooling channel and not the sequential liner inner wall to direct a convective cooling flow into the sequential liner cooling channel adjacent to each adjacent face.

2. The sequential liner of claim 1, comprising:

at least one rib between the sequential liner inner wall and the sequential liner outer wall of the first adjacent face for directing the convective cooling flow.

3. The sequential liner of claim 2, wherein the at least one rib extends across part of the distance between the sequential liner outer wall and the sequential liner inner wall.

4. The sequential liner of claim 2, in which at least one of the one or more ribs is substantially parallel to a gas turbine combustor hot gas flow.

5. The sequential liner of claim 2, comprising:

a plurality of ribs, wherein each rib has a downstream end and an upstream end relative to the flow of cooling air, and wherein the upstream ends of the ribs are further apart from one another than the downstream ends of the ribs.

6. The sequential liner of claim 5, wherein one or more of the ribs are curved.

7. The sequential liner of claim 1, wherein each of the first convective cooling hole and the second convective cooling hole comprise:

at least two separate holes adjacent to one another.

8. The sequential liner of claim 1, wherein the longest distance across each convective cooling hole is at least twice the length of the shortest distance across each respective convective cooling hole.

9. The sequential liner of claim 1, comprising:

a plurality of impingement cooling holes in the sequential liner outer wall.

10. The sequential liner of claim 1, wherein the plurality of impingement cooling holes are smaller than the first convective cooling holes.

11. A gas turbine comprising the sequential liner of claim 1.

12. A method of cooling a sequential liner for a gas turbine combustor having a sequential liner outer wall spaced apart from a sequential liner inner wall to define a sequential liner cooling channel between the sequential liner outer wall and the sequential liner inner wall, the sequential liner outer wall having a first face, a first adjacent face and a second adjacent face, the first and second adjacent faces each being adjacent to the first face, the first face of the sequential liner outer wall having a first convective cooling hole adjacent to the first adjacent face and a second convective cooling hole adjacent to the second adjacent face, each convective cooling hole being arranged to face the cooling channel and not the sequential liner inner wall to direct a convective cooling flow into the sequential liner cooling channel adjacent to each adjacent face, the method comprising:

feeding cooling air through the convective cooling holes into the sequential liner cooling channel; and convectively cooling the sequential liner inner wall with the cooling air.

13. A method of retrofitting a gas turbine having a sequential liner with a sequential liner outer wall spaced apart from a sequential liner inner wall to define a sequential liner cooling channel between the sequential liner outer wall and the sequential liner inner wall, the method comprising:

removing the sequential liner outer wall; and adding a new sequential liner outer wall, the sequential liner outer wall having a first face, a first adjacent face and a second adjacent face, the first and second adjacent faces each being adjacent to the first face, the first face of the sequential liner outer wall having a first convective cooling hole adjacent to the first adjacent face and a second convective cooling hole adjacent to the second adjacent face, each convective cooling hole being arranged to face the cooling channel and not the sequential liner inner wall to direct a convective cooling flow into the sequential liner cooling channel adjacent to each adjacent face.

14. The method of claim 13, comprising:

attaching at least one rib to the sequential liner inner wall before adding a new sequential liner outer wall.

* * * * *